US010769926B1

(12) United States Patent
Rogers et al.

(10) Patent No.: US 10,769,926 B1
(45) Date of Patent: Sep. 8, 2020

(54) STAIR LIFT MONITORING

(71) Applicant: Alarm.com Incorporated, Tysons, VA (US)

(72) Inventors: Thomas Rogers, Frederick, MD (US); Lainie Muller, Chevy Chase, MD (US); Donald Faraci, Falls Church, VA (US)

(73) Assignee: Alarm.com Incorporated, Tysons, VA (US)

( * ) Notice: Subject to any disclaimer, the term of this patent is extended or adjusted under 35 U.S.C. 154(b) by 0 days.

(21) Appl. No.: 16/352,176

(22) Filed: Mar. 13, 2019

Related U.S. Application Data

(60) Provisional application No. 62/642,333, filed on Mar. 13, 2018.

(51) Int. Cl.
*G08B 21/00* (2006.01)
*G08B 21/04* (2006.01)
*B66B 9/08* (2006.01)

(52) U.S. Cl.
CPC ..... *G08B 21/0461* (2013.01); *B66B 9/08* (2013.01); *G08B 21/0476* (2013.01); *G08B 21/0484* (2013.01)

(58) Field of Classification Search
CPC .. H21J 3/382; H21J 3/383; H21J 3/386; H21J 9/061; H21J 7/007; A61G 5/061; B66B 9/08; H04W 40/00; H04W 72/00
See application file for complete search history.

(56) References Cited

U.S. PATENT DOCUMENTS 5,052,521 A * 10/1991 Wendt ..... B66B 9/083 182/148
7,156,208 B2 1/2007 Rickaby
8,660,565 B2 * 2/2014 Hall ..... B66B 5/0031 455/447
9,457,992 B2 * 10/2016 Ooms ..... B66B 9/08
9,751,724 B2 * 9/2017 Ooms ..... H04W 8/22
9,776,830 B2 10/2017 Ooms
2004/0238286 A1 12/2004 Vroegindeweij et al.
2010/0133045 A1 6/2010 Turina
2010/0314201 A1 * 12/2010 Stannah ..... B66B 9/08 187/201
2011/0278096 A1 * 11/2011 Kentenich ..... B66B 1/34 187/201
2012/0261216 A1 10/2012 Hrenchir et al.
2014/0326540 A1 11/2014 Ooms
2016/0268805 A1 * 9/2016 Finn ..... H02J 1/108
2017/0243365 A1 8/2017 Nuijten

* cited by examiner

*Primary Examiner* — Toan N Pham
(74) *Attorney, Agent, or Firm* — Fish & Richardson P.C.

(57) ABSTRACT

A monitoring system that is configured to monitor a property is disclosed. The monitoring system includes a sensor that is configured to generate sensor data that reflects an attribute of the property. The monitoring system further includes a stair lift that is configured to transport a person up and down stairs at the property and that is configured to generate stair lift data that reflects a status of the stair lift. The monitoring system further includes a monitor control unit that is configured to receive the sensor data and the stair lift data. The monitor control unit is further configured to analyze the sensor data and the stair lift data. The monitor control unit is further configured to determine that an event occurred at the property. The monitor control unit is further configured to, based on determining that the event occurred at the property, perform a monitoring system action.

18 Claims, 4 Drawing Sheets

STAIR LIFT MONITORING

CROSS-REFERENCE TO RELATED APPLICATION

This application claims the benefit of U.S. Application No. 62/642,333, filed Mar. 13, 2018, which is incorporated by reference.

TECHNICAL FIELD

This disclosure generally related to monitoring systems.

BACKGROUND

Homes and other facilities are sometimes equipped with stair lifts to assist the elderly, or other people with reduced mobility, to move from one floor to another floor.

SUMMARY

As people age, they often lose mobility, making it more difficult for them to move freely about their homes. Using stairs to move between different floors of a home can be particularly difficult for the elderly and others with reduced mobility. To assist in moving between floors, many people equip their homes with one or more stair lifts, which can transport a person up or down a set of stairs while the person remains seated.

Many homes are also equipped with a home monitoring system to enhance the home's security and safety. For example, a home monitoring system can include sensors that detect a condition of the home (e.g., vacant, occupied) and controls that enable automation of various home functions (e.g., turning lights on or off, locking doors). Some home monitoring systems enable detection of one or more events (e.g., door left open, unauthorized entry) and can notify a resident, or other individual or entity (e.g., a security guard, an alarm server, or emergency services), when an event is detected.

The described systems and techniques include a home monitoring system that communicates with one or more sensors and controls of a stair lift located in the home. By communicating with the stair lift sensors and controls, the home monitoring system can enhance the comfort, convenience, and safety of a stair lift user.

Certain implementations have particular advantages. In some implementations, the systems and techniques enable automation of various home actions related to a stair lift according to one or more rules set by a user. For example, a user can set a rule indicating that, if the stair lift moves from a lower floor to an upper floor between 10 PM and midnight, the home monitoring system should turn off the lights of the lower floor and adjust a thermostat setting. In this way, the home monitoring system can automatically adjust the lower floor lights and thermostat when the stair lift user goes to bed at night.

In some implementations, the system and techniques provide enhanced convenience for the stair lift user. For example, based on data from a motion detector and the stair lift, the home monitoring system may determine that the user is on an upper floor of the home, while the stair lift seat is located at the lower floor of the home. The home monitoring system can command the stair lift control to move the stair lift seat from the lower floor to the upper floor so that it is available to the user.

In some implementations, the system and techniques enhance the safety of the stair lift user. For example, based on data from a sensor of the stair lift, the home monitoring system may detect that a user has potentially experienced a hazardous event (e.g., the stair lift has stopped moving unexpectedly or the user has fallen from the stair lift seat). In such situations, the home monitoring system can stop the stair lift if it is in motion and alert a caregiver, for example, by sending a notification to the caregiver's mobile device. In some examples, the home monitoring system can activate an electronic home assistant or smart speaker to ask the user if he requires aid or notify emergency services personnel.

According to an innovative aspect of the subject matter described in this application, a monitoring system is configured to monitor a property. The monitoring system includes a sensor that is configured to generate sensor data that reflects an attribute of the property; a stair lift that is configured to transport a person up and down stairs at the property and that is configured to generate stair lift data that reflects a status of the stair lift; and a monitor control unit that is configured to receive the sensor data and the stair lift data; analyze the sensor data and the stair lift data; based on analyzing the sensor data and the stair lift data, determine that an event occurred at the property; and, based on determining that the event occurred at the property, perform a monitoring system action.

These and other implementations can each optionally include one or more of the following features. The monitor control unit is configured to determine that an event occurred at the property by determining that the property is likely occupied by a resident; determining that a seat of the stair lift seat is occupied; determining that the stair lift is not moving and is located between an upper floor and a lower floor; and, based on (i) determining that the property is likely occupied by the resident, (ii) determining that the seat of the stair lift seat is occupied, and (iii) determining that the stair lift is not moving and is located between the upper floor and the lower floor, determining that the resident is likely located on the stair lift that is not moving and that is located between the upper floor and the lower floor; and perform the monitoring system action by outputting a notification indicating that the resident is likely located on the stair lift that is not moving and that is located between the upper floor and the lower floor.

The monitor control unit is configured to determine that an event occurred at the property by determining that the property is likely occupied by a resident; determining that a seat of the stair lift seat is occupied; determining that the stair lift is not moving and is located between an upper floor and a lower floor; and, based on (i) determining that the property is likely occupied by the resident, (ii) determining that the seat of the stair lift seat is occupied, and (iii) determining that the stair lift is not moving and is located between the upper floor and the lower floor, determining that the resident is likely located on the stair lift that is not moving and that is located between the upper floor and the lower floor; and perform the monitoring system action by activating a camera that is trained on the stair lift; and outputting image data received from the camera that is trained on the stair lift.

The monitor control unit is configured to determine that an event occurred at the property by determining that an upper floor of the property is likely occupied by a resident; determining that the resident is likely moving to a lower floor of the property; and determining that a seat of the stair lift is located at the lower floor; and perform the monitoring system action by generating an instruction for the stair lift to move to the upper floor of the property based on (i) determining that the upper floor of the property is likely occupied by a resident, (ii) determining that the resident is likely moving to the lower floor of the property, and (iii) determining that a seat of the stair lift is located at the lower floor.

The monitor control unit is configured to perform a monitoring system action by generating an instruction to activate lights on the lower floor based on (i) determining that the upper floor of the property is likely occupied by a resident, (ii) determining that the resident is likely moving to the lower floor of the property, and (iii) determining that a seat of the stair lift is located at the lower floor. The monitor control unit is configured to determine that an event occurred at the property by determining that a lower floor of the property is likely occupied by a resident; determining that the resident is likely moving to an upper floor of the property; and determining that a seat of the stair lift is located at the upper floor; and perform the monitoring system action by generating an instruction for the stair lift to move to the lower floor of the property based on (i) determining that the lower floor of the property is likely occupied by a resident, (ii) determining that the resident is likely moving to the upper floor of the property, and (iii) determining that a seat of the stair lift is located at the upper floor.

The monitor control unit is configured to perform a monitoring system action by generating an instruction to set the monitoring system to armed stay mode based on (i) determining that the lower floor of the property is likely occupied by a resident, (ii) determining that the resident is likely moving to the upper floor of the property, and (iii) determining that a seat of the stair lift is located at the upper floor. The monitor control unit is configured to determine that an event occurred at the property by determining that the property is likely occupied by a resident; determining that a seat of the stair lift seat is unoccupied; determining that the stair lift is moving; and based on (i) determining that the property is likely occupied by the resident, (ii) determining that the seat of the stair lift seat is unoccupied, and (iii) determining that the stair lift is moving, determining that the resident likely fell off the stair lift; and perform the monitoring system action by outputting a notification indicating that the resident likely fell off the stair lift.

The monitor control unit is configured to determine that an event occurred at the property by determining that the stair lift is being misused; and perform the monitoring system action by outputting a notification indicating that the stair lift is being misused. The stair lift includes a stair lift module that is integrated with the stair lift and that is configured to generate the stair lift data. The stair lift include a stair lift module that is detachable from the stair lift and that is configured to generate the stair lift data.

Other implementations of this aspect include corresponding systems, apparatus, and computer programs recorded on computer storage devices, each configured to perform the operations of the methods.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
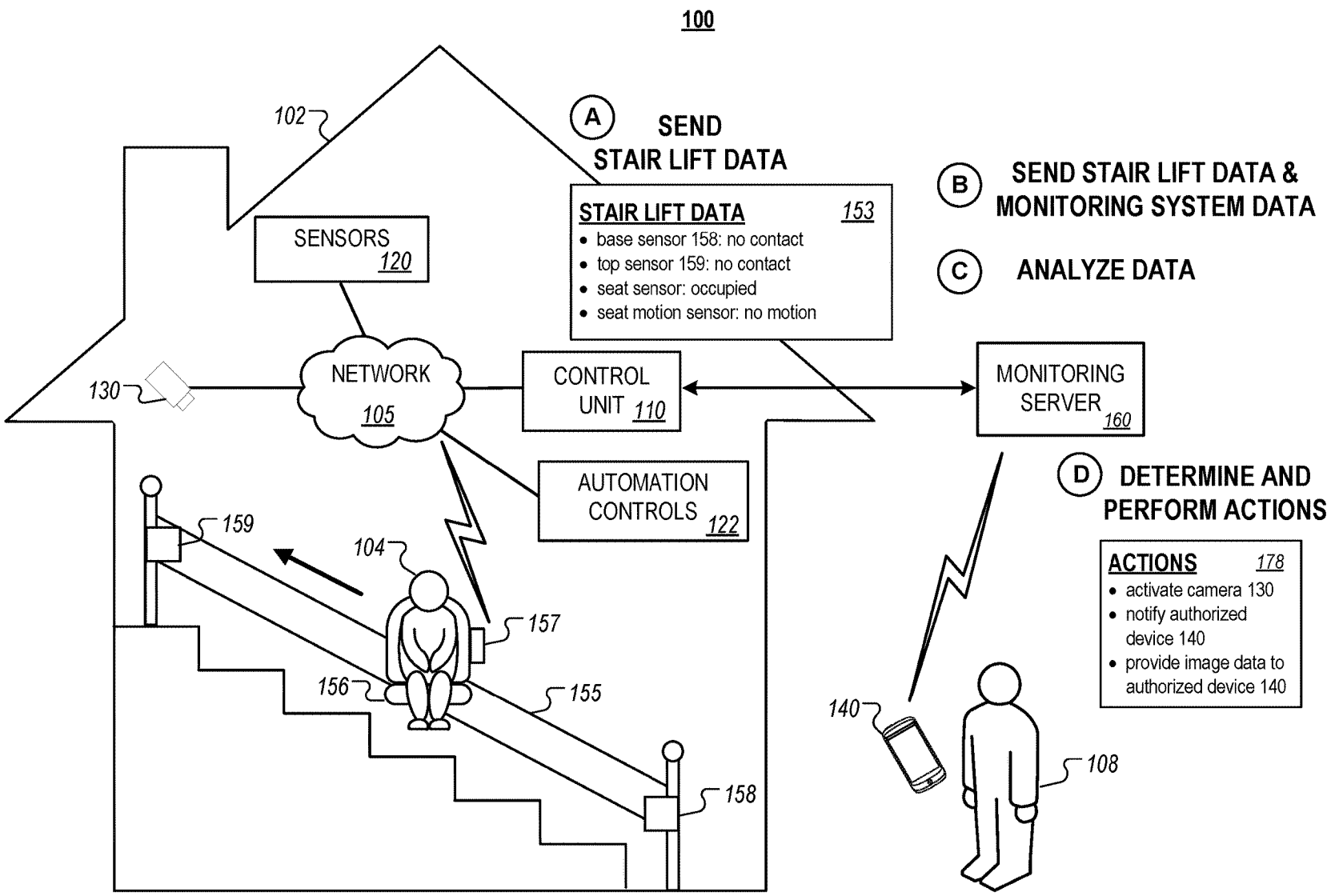
FIG. 1 is a diagram illustrating an example of a system for stair lift monitoring.

FIG. 1 is a diagram illustrating an example of a system 100 for stair lift monitoring. System 100 includes a home 102 monitored by a home monitoring system and a stair lift 155 that transports a user 104 up and/or down a set of stairs of the home 102. The home monitoring system includes a monitoring server 160, which receives data related to the stair lift 155, as well as other monitoring system data. Based on analyzing the received data, the monitoring server determines and performs one or more monitoring system actions. FIG. 1 includes stages (A) through (D), which represent a flow of data.

System 100 includes a home, a place of business, or another facility 102 monitored by a home monitoring system. The home monitoring system includes one or more sensors 120 located in the home 102 that collect sensor data related to the home 102. For example, the sensors 120 can include motion detectors that sense movement in an area of the home 120. The sensors 120 can also include appliance sensors, door or window lock sensors, utility or resource usage sensors, microphones, temperature or humidity sensors, light detectors, or other sensors. Other possible sensors are described below in FIG. 4.

In some implementations, the sensors 120 include one or more cameras 130 located in the home 102 that record static or video images of a region of the home 102. In FIG. 1, the home monitoring system includes a camera 130 located near a set of stairs of the home 102, such that it records images of activity on the stairs.

The sensors 120 can also include one or more health monitoring sensors. In some examples, the health monitoring sensors 120 are worn by the user 104 and collect data related to the user's health and fitness. The health monitoring sensors 120 can provide information including respiration rate, pulse rate, and activity status (e.g. whether an individual is still or in motion). In some examples, the sensors 120 also include one or more chair sensors and/or bed sensors. The chair sensors and/or bed sensors can, for example, be in the form of a pressure-sensing pad or mat that indicates when a chair or bed is occupied.

The sensors 120 communicate with a control unit 110 that is located at the home 102. The control unit 110 can be, for example, a computer system or other electronic device configured to communicate with the sensors 120 and perform various functions for the home monitoring system. In some implementations, the user 104 or another person can communicate with the control unit 110 through a physical connection (e.g., touch screen, keypad, etc.) and/or a network connection.

The sensors 120 may communicate with the control unit 110 through a network 105. The network 105 can be any communication infrastructure that supports the electronic exchange of data between the control unit 110 and the one or more sensors 120. For example, the network 105 may include a local area network (LAN). The network 105 may be any one or combination of wireless or wired networks and may include any one or more of Ethernet, Bluetooth, Bluetooth LE, Z-wave, Zigbee, Wi-Fi, or cellular telephony (e.g., LTE, GSM or GPRS, CDMA, EDGE or other cellular data transfer protocol) technologies. In some examples, the network 105 may include a wireless mesh network or other distributed communication infrastructure.

The sensors 120 send various sensor data to the control unit 110. For example, the sensors 120 can send motion sensing data from one or more motion detectors, status data from one or more door or lock sensors (e.g., door open, lock secured), or light level data from one or more light detectors. Similarly, one or more cameras 130 can send image or video data to the control unit 110.

The control unit 110 also communicates with one or more home automation controls 122, possibly through the network 105. The home automation controls 122 connect to one or more devices of the home 102 and enable control of various home actions. For example, the home automation controls 122 can adjust a setting on a thermostat, turn on or off one or more lights, adjust a setting on an appliance, secure a door lock, open a garage door, or control other devices of the home 102.

The home 102 also includes a stair lift 155 for moving the user 104 between floors of the home 102. The stair lift 155 may be installed alongside a set of stairs and can be of any of various designs. For example, a stair lift 155 can include a set of parallel rails mounted on a wall adjacent to the stairs, where the rails extend from the base of the stairs to the top of the stairs. The stair lift 155 can also include an electromechanical seat 156 attached to the rails. The stair lift 156 can include a motor, which moves the seat 156 along the rails between a location at the base of the stairs and a location at the top of the stairs under electronic control. The user 104 can sit in the seat 156 while it moves, and so travel up or down between floors of the home 102 without manually climbing the stairs.

Connected to the stair lift 155 is a stair lift module 157 that communicates with the control unit 110. For example, the stair lift module 157 can communicate wirelessly with the control unit 110 through the network 105. In some examples, the stair lift module 157 attaches to the stair lift seat 156 (e.g., underneath the seat). In some examples, the stair lift module 157 attaches to a stationary part of the stair lift 155.

In some implementations, the electric power to the stair lift 155 can be routed through a switch in the stair lift module 157. For example, the stair lift module 157 can include both an electric plug and a receptacle. The stair lift 155 power plug can be inserted into the stair lift module 157 receptacle, while the stair lift module 157 plug is inserted into a wall outlet, with the power signal routed between a controllable switch. In this way, the stair lift module 157 can disconnect the electric power to the stair lift 155 by opening the switch.

The stair lift module 157 communicates with one or more sensors of the stair lift 155. For example, the stair lift 155 may include a seat sensor that detects whether the user 104 is sitting on the seat 156 of the stair lift 155. The seat sensor can be, for instance, a force or pressure sensor that detects when a certain weight is present on the seat 156.

In some implementations, the stair lift 155 includes sensors that detect the location of the seat 156. For example, as shown in FIG. 1, the stair lift 155 can have a base sensor 158 and a top sensor 159, positioned near the ends of the stair lift 155, at the base and the top of the stairs, respectively. In some examples, the base sensor 158 and top sensor 159 detect physical contact with the seat 156. When the base sensor 158 detects contact, the seat 156 is presumed to be at the base of the stairs (e.g., at the lower floor), when the top sensor 159 detects contact, the seat 156 is presumed to be at the top of the stairs (e.g., at the upper floor). When neither the base sensor 158 nor the top sensor 159 detects contact, the seat 156 is presumed to be somewhere along the rails on the stairs (e.g., between the lower and upper floors).

The stair lift 155 can also include sensors that detect motion of the stair lift seat 156, sensors that detect the location of the seat 156 along the rails (e.g., two feet from the base of the rails, halfway between the base and the top of the rails, etc.), or other sensors. In some examples, the stair lift 155 includes a tilt sensor that detects when the stair lift seat 156 has separated from the wall. The tilt sensor can be a micro-switch, a snap-action switch, or another persistent or momentary contact sensor that provides an indication of the stair lift seat's 156 contact with the wall. In some examples, the tilt sensor can be an accelerometer, a gyroscope or another sensor that provides an indication of the position and/or orientation of the stair lift seat 156.

In some implementations, the stair lift module 157 and/or one or more of the stair lift sensors can be integrated into the stair lift 155 by the stair lift manufacturer. In some implementations, the stair lift module 157 and/or one or more of the sensors can be separate units attached by a third party (e.g., the user 104, a contractor, a vendor).

In stage (A), the stair lift module 157 sends stair lift data 153 to the control unit 110. The stair lift data 153 can include, for example, data from the one or more stair lift sensors (e.g., data from the base sensor 158, the top sensor 159, the seat sensor). The stair lift data 153 can provide information related to the position and/or motion of the seat 156 on the stair lift 155, the occupancy of the seat 156 (e.g., whether a person is sitting in the seat 156), a change in occupancy of the seat 156 (e.g., a person was in the seat but is not now), a status of the stair lift 155 (e.g., powered off, in use, idle), or other information related to the stair lift 155.

In the example of FIG. 1, the seat 156 of the stair lift 155, occupied by the user 104, has stopped midway between the lower and upper floors. As a result, the stair lift module 157 sends stair lift data 153 to the control unit 110 indicating that (i) the seat 156 is not in contact with the base sensor 158, (ii) the seat 156 is not in contact with the top sensor 159, (iii) the seat sensor indicates that the seat 156 is occupied, and (iv) the seat 156 is not in motion.

In stage (B), the control unit 110 sends stair lift data 153 and monitoring system data to the remote monitoring server 160. The monitoring server 160 may be, for example, one or more computer systems, server systems, or other computing devices located away from the home 102. In some implementations, the monitoring server 160 is a cloud computing platform.

The control unit 110 communicates with the monitoring server 160 via a long-range data link. The long-range data link can include any combination of wired and wireless data networks. For example, the control unit 110 can exchange information with the monitoring server 160 through a wide-area-network (WAN), a cellular telephony network, a wireless data network, a cable connection, a digital subscriber line (DSL), a satellite connection, or other electronic means for data transmission. The control unit 110 and the monitoring server 160 may exchange information using any one or more of various communication synchronous or asynchronous protocols, including the 802.11 family of protocols, GSM, 3G, 4G, 5G, LTE, CDMA-based data exchange or other techniques.

The control unit 110 can send some or all of the stair lift data 153 received from the stair lift module 157 to the monitoring server 160. In some implementations, the control unit 110 processes (e.g., filters, transforms, modifies) the stair lift data 153 before sending it to the stair lift module 157.

The control unit 110 also sends monitoring system data to the monitoring server 160. The monitoring system data can include sensor data collected by one or more sensors 120, for example, motion sensing data collected by a motion detector or door lock data collected by a door lock sensor. The monitoring system data can also include image data from one or more cameras 130. In some examples, the monitoring system data includes a monitoring system status or condition (e.g., "away," "home," "unarmed," etc.), time data, and/or date information. The monitoring system data can also include information related to other devices connected to the monitoring system. For example, the monitoring system data can include a device status (e.g., whether particular lights are powered on, whether particular doors are locked, etc.) or a device setting (e.g., a thermostat setting, an appliance setting).

In stage (C), the monitoring server 160 analyzes the stair lift data 153 and monitoring system data received from the control unit 110. For example, the monitoring server 160 can include an analysis engine that analyzes and processes the data. In some examples, the analysis engine includes one or more machine learning models that are trained on various data. For example, the analysis engine can include a neural network, a maximum entropy model, a decision tree, a support vector machine, a regression model, or another model.

In some implementations, the monitoring server 160 analyzes the received stair lift data 153 and the monitoring system data to determine that an event has potentially occurred. For example, based on receiving data indicating that an occupied stair lift seat 156 moved from a lower floor to an upper floor, the monitoring server 160 may determine that the user 104 is potentially on an upper floor. Similarly, based on receiving data indicating that an unoccupied stair lift seat 156 moved from a lower floor to an upper floor, the monitoring server 160 may determine that the user 104 is potentially preparing to descend to the lower floor.

In some examples, the monitoring server 160 may determine that a hazardous event has potentially occurred. For example, the server 160 can analyze data to determine that the stair lift seat 156 unexpectedly stopped when moving between floors, which could indicate that the user 104 experienced a medical emergency or that the stair lift 155 malfunctioned.

The server 160 can use various stair lift data 153 and/or monitoring system data to discriminate between potentially hazardous events. For example, the server 160 may receive monitoring system data indicating a power failure that may have caused the stair lift seat 156 to stop or stair lift control data 153 indicating a temporary malfunction. The server 160 may also receive data from a health monitoring sensor 120 worn by the user 104, which can inform a determination of a medical emergency, or data from a seat sensor indicating that the user 104 has potentially fallen from the seat 156.

In some implementations, the monitoring server 160 analyzes data from more than one time to determine that one or more events have potentially occurred. For example, the server 160 may analyze stair lift data 153 from a seat sensor to determine that the occupancy of the seat 156 has changed in a given time period (e.g., the user 104 has fallen from the seat 156), or motion data to determine that the seat 156 has not moved in two minutes.

In some cases, the monitoring server 160 analyzes stair lift data 153 and other monitoring system data to detect an activity pattern of the user 104. Based on the detected activity pattern, the server 160 may determine one or more potential events. For example, the server 160 may receive monitoring system data that includes image data from a camera 130 showing the user 104 walking on an upper floor, as well as stair lift data 153 indicating that the stair lift seat 156 is occupied and in motion. If the user 104 is the only authorized stair lift user in the home, the server 160 may determine that the stair lift 155 is being used by an unauthorized person.

In some examples, the server 160 can detect an activity pattern that corresponds to a predetermined or learned activity pattern of the user 104. For example, the server 160 may receive monitoring system data indicating that it is 11 PM and that the television on the lower level was recently powered off, as well as stair lift data 153 indicating that the stair lift seat 156 is occupied and is moving from the lower floor to the upper floor. Based on the activity pattern, the server 160 may determine that the user 104 is going to bed for the night.

In the example of FIG. 1, the monitoring server 160 receives stair lift data 153 indicating that the seat 156 is located in between the base and the top of the stairs, that the seat 156 is occupied, and that the seat 156 is not moving. Furthermore, the server 160 receives monitoring system data from a health sensor 120 worn by the user 104 indicating a lower-than-normal respiratory rate. Based on the received data, the monitoring server 160 determines that the user 104 has potentially experienced a medical emergency.

In stage (D), based on analyzing the stair lift data 153 and the monitoring system data, the monitoring server 160 determines and performs one or more monitoring system actions 178. In some examples, the monitoring server 160 determines the actions 178 based on detecting a potential event. The monitoring system actions 178 can be any of various operations or actions that can be performed by the monitoring server 160 or by another device of the monitoring system. For example, the monitoring system actions 178 can include setting a status of the monitoring system (e.g., "armed," "home," "away"), activating a monitoring system sensor 120, or triggering recording of a monitoring system camera 130.

The actions 178 can include providing a command to one or more home automation controls 122 to control a device connected to the monitoring system. For example, the actions 178 can cause the automation controls 122 to adjust a thermostat setting, to turn on or off one or more lights in the home, to secure or unlock a door or window lock, to start or stop an appliance, or to control another device connected to the monitoring system. In some implementations, the action 178 provides a command to an electronic home assistant or smart speaker (e.g., commanding the smart speaker to broadcast a message to the user 104 or to wait for a response from the user 104).

In some implementations, the actions 178 include providing a command to the stair lift 155 through the stair lift module 157. For example, the monitoring server 160 can send a command to the stair lift module 157 to cause the stair lift seat 156 to begin moving, to stop moving, or to move from one position to another position. The server 160 can also send a command to disconnect power to the stair lift 155.

In some implementations, the actions 178 include sending a notification or alert to an authorized device 140. For example, the server 160 can send a notification indicating a potential hazardous event has occurred.

The authorized device 140 can be, for example, a mobile phone, a tablet, a smart phone, or another mobile computing device that electronically communicates with the monitoring server 160 and/or the control unit 110. In some examples, the authorized device 140 is associated with the user 104, with a caregiver 108, or with another individual. The monitoring server 160 and/or the control unit 110 can communicate with the authorized device 140 through a wireless network, for example, a cellular telephony network, data network, WiFi, Bluetooth, or other wireless communication network.

In some examples, the authorized device 140 communicates with the monitoring server 160 and/or the control unit 110 through an application running on the device 140. The application can be any combination of software, hardware, or firmware, and enables the authorized device 140 to electronically communicate with the monitoring system. For example, through the application, the authorized device 140 may be able to view and/or adjust a status of the monitoring system (e.g., "armed," "away," "home"), view and/or initiate recording of data from a monitoring system sensor 120 or camera 130, and view and/or adjust a setting of a device connected to the monitoring system (e.g., change a thermostat setting, turn on a light, move the stair lift seat 156). The authorized device 140 can be configured to receive notifications, alerts, and/or messages from the monitoring server 160 and/or the control unit 110.

In some implementations, the server 160 determines and performs actions 178 that include sending a notification or alert to another authorized party, for example, to a central alarm server, a security guard, emergency services personnel, or another authorized individual. In some examples, a party can be authorized by the user 104 or by the caregiver 108, for example, through an application running on the authorized device 140.

In some implementations, the monitoring server 160 determines one or more monitoring system actions 178 based on applying one or more rules. The rules can be predetermined (e.g., default rules) or can be set by the user 104 or another individual (e.g., customized rules). The rules can indicate the actions 178 that the monitoring server 160 should perform given a particular analysis of the stair lift data 153 and the monitoring system data (e.g., detection of a particular potential event). For example, the rules can indicate that, if the monitoring server 160 determines that the user 104 potentially experienced a hazardous event while using the stair lift 155, the server 160 should activate a camera 130 located near the stair lift 155 and send a command to a smart speaker to ask the user 104 if he needs assistance.

In FIG. 1, based on determining that the user 104 potentially experienced a hazardous event, the monitoring server 160 performs actions 178, which include activating the camera 130, which is located near the stair lift 155, sending a notification to the authorized device 140, and providing image data from the camera 130 to the authorized device 140.

In some examples, the server 160 can send notifications to more than one authorized device 140. The server 160 may send different notifications to different authorized devices 140 based on the potential event detected. For example, the server 160 may send a notification to an authorized device 140 associated with a caregiver if it determines that the user 104 has potentially experienced a medical emergency. However, the server 160 may send a notification to an authorized device 140 associated with the user 104 if it determines that the stair lift 155 was potentially used by an unauthorized person.

The monitoring server 160 may also perform various other actions 178. For example, the monitoring server 160 may command a robotic device (e.g., a drone) to go near to or attend to the user 104. The monitoring server 160 may contact emergency services personnel or sound an audible alarm at the home 102.

In some implementations, the monitoring server 160 may disconnect the power to the stair lift 155. For example, based on the received data, the monitoring server 160 may determine that the user 104 has potentially fallen from the stair lift seat 156, but that the seat 156 is still in motion. The monitoring server 160 may send a command to the stair lift module 157 to disconnect the input power to the stair lift 155 to stop the seat 156 from moving.

In some implementations, the monitoring server 160 may analyze the stair lift data 153 to monitor the stair lift 155 for recommended maintenance. For example, based on data 153 indicating the status of the stair lift 155 (e.g., powered off, in use, idle), the server 160 can track the number of hours that the stair lift 155 has been used since its last servicing. The monitoring server 160 can then send a notification to an authorized device 140 to advise the user 104 or the caregiver when the stair lift 155 is due for preventive maintenance or other service.

In some implementations, the stair lift 155 may include a camera that is mounted to the stair lift chair. The camera may be located above the seat 156 have a field of view that includes the seat 156. The monitoring server 160 may receive and perform analytics on the image data from the camera. The monitoring server 160 may determine whether the user 104 has fallen from the seat 156 based on performing analytics. During performance of the analytics, the monitoring server 160 may determine whether the user 104 has crossed a predetermined line. If the user 104 has crossed the predetermined line, then the monitoring server 160 may determine that the user 104 has fallen from the seat 156. Additionally or alternatively, the monitoring server 160 may apply a model trained using machine learning to determine whether the user 104 has fallen from the seat 156. The model may be trained on labeled images of persons on the seat 156 and labeled images of persons who have fallen from the seat 156. The camera may be activated in response to a determination by the system such as usage of the stair lift or may always be on.

In some implementations, the stair lift 155 may include a microphone. The microphone may be always be active or may be activated in response to a determination by the monitoring server 160 or the stair lift 155. For example, the monitoring server 160 or the stair lift 155 may determine that the user 104 has fallen from the seat 156 and activate the microphone in response. The microphone may connect to a central station so that an operator at the central station can communication with the user 104.

In some implementations, the seat 156 of the stair lift 155 may include a scale. The monitoring server 160 may receive a weight reading from the scale. The stair lift 155 or the monitoring server 160 may be able to determine who is likely using the stair lift 155 based on the weight reading. The user 104 and any other users of the stair lift in the home may initialize the scale by providing an indication to the stair lift 155 that a new user is sitting on the seat 156. The stair lift 155 may respond normally when the stair lift detects a recognized weight. Upon detection of a weight that does not match a recognized weight, the stair lift 155 may provide an indication to the monitoring server 160. The monitoring server 160 may respond differently depending on the armed status of the monitoring system and/or the data received from other sensors. For example, if the weight does not match a recognized weight, the monitoring system is armed stay or away, and the data from the other sensors indicates that the property is likely unoccupied, then the monitoring server 160 may generate an alarm. As another example, if the weight does not match a recognized weight, the monitoring system is unarmed, and the data from the other sensors indicates that the property is likely occupied, then the monitoring server 160 may generate a notification and provide the notification to a resident of the property.

In some implementations, the monitoring server 160 may determine that an emergency event is occurring at the property. For example, the monitoring server 160 may determine that there is a fire at the property. In response to the emergency event, the monitoring server 160 may analyze the sensor data to determine that a resident of the property is likely on a level of the property that does not include a door to the outside. The monitor server 160 may provide an instruction to the stair lift 155 to move to the floor where the resident is located. Upon detection of the resident sitting down on the seat 156, the stair lift 155 may automatically move to the floor with the door to the outside.

Figure 2A:
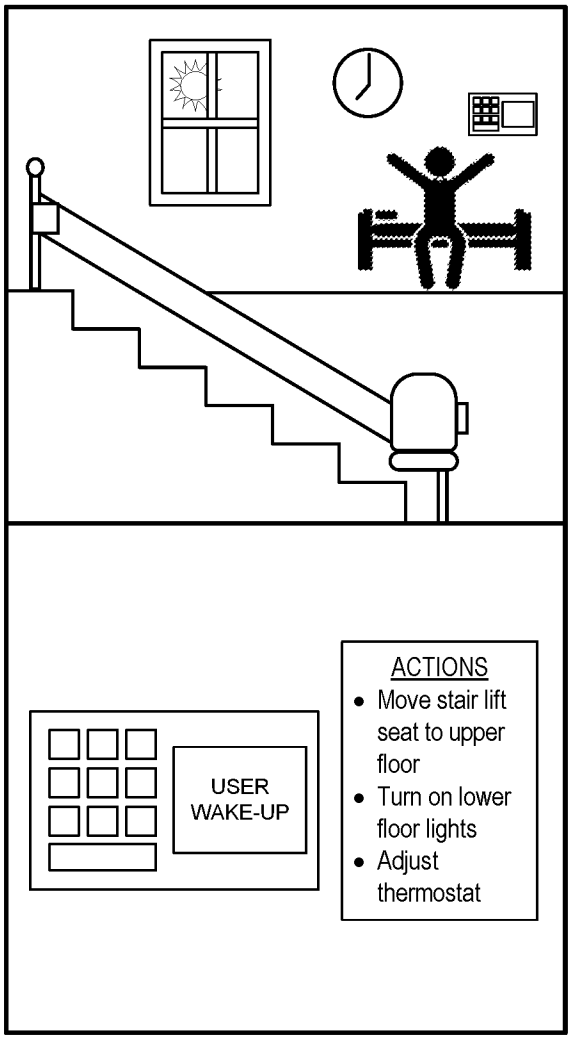
FIGS. 2A, 2B, and 2C are diagrams illustrating examples of scenarios using stair lift monitoring.
Figure 2B:
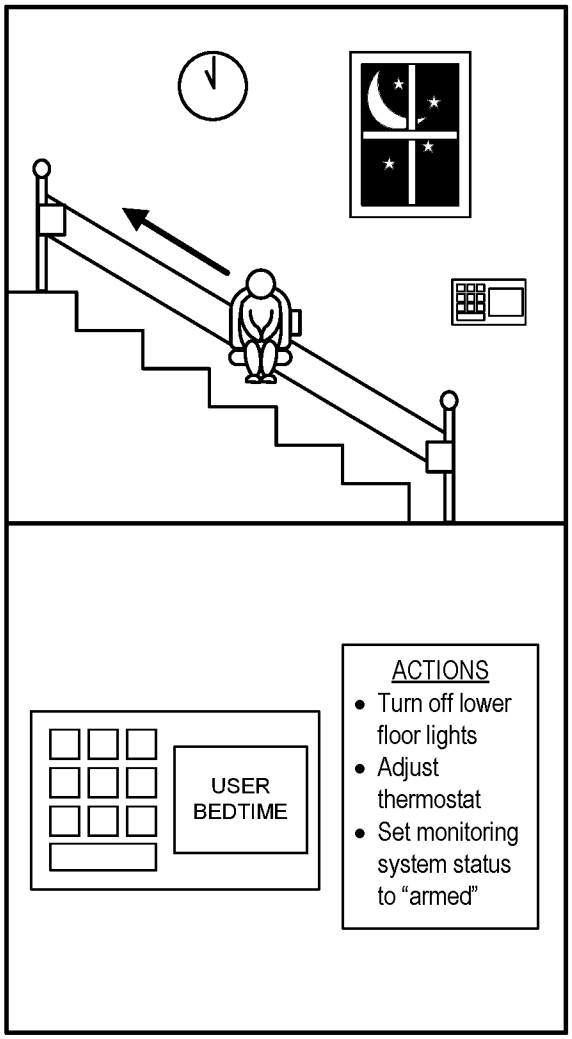
Figure 2C:
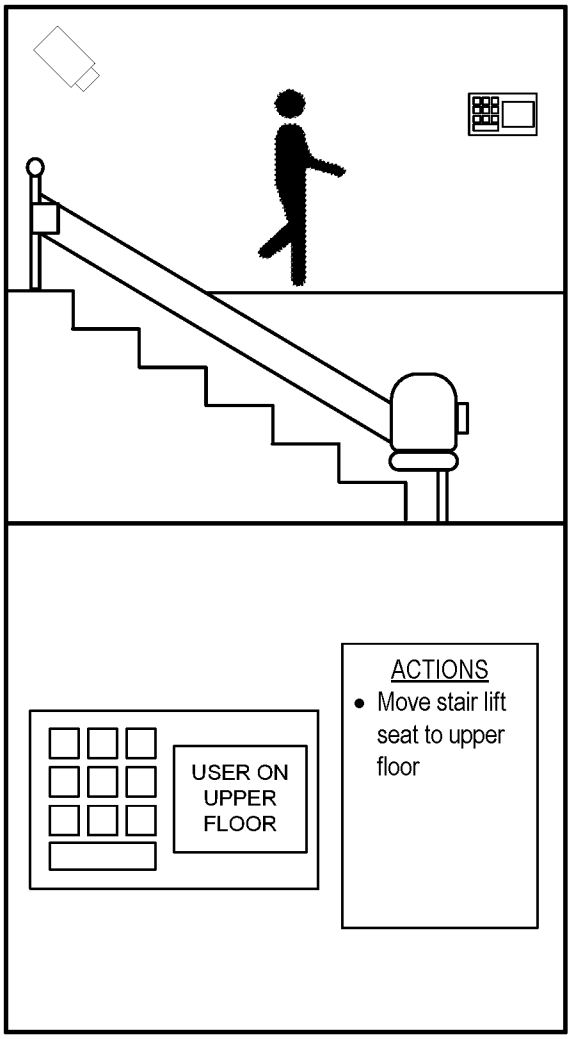

FIGS. 2A, 2B, and 2C are diagrams illustrating examples of scenarios 200, 220, and 240, respectively using stair lift monitoring. In the example scenarios, the monitoring server performs various actions in response to detecting that the user has awoken in the morning (200), that the user is going to bed for the night (220), and that stair lift seat is located at a different floor than the one the user is on (240).

In scenario 200 of FIG. 2A, based on stair lift data and monitoring system data received from the control unit, the monitoring server determined that the user has awoken in the morning on the upper floor of the home. For example, the monitoring server may have received motion sensing data indicating that motion was detected on the upper floor of the home and that the time is 7:00 AM. In some examples, the user may notify the monitoring server that he has awoken by pressing a button on a device connected to the monitoring system or by sending a message to the monitoring server using an application on his authorized mobile device. The monitoring server can also receive data related to the stair lift. In scenario 200, the server received data indicating that the stair lift seat was at the base of the stairs, near the lower floor. The user and the seat may be located on different floors for any of various reasons. For instance, the user may have walked up the stairs to arrive at the second floor, or the stair lift seat may have been returned to the base of the stairs for stowage overnight.

Based on determining that the user has awoken in the morning, the monitoring server performs monitoring system actions to enhance the user's convenience, safety, and comfort. In scenario 200, because the stair lift seat is at the base of the stairs, the monitoring server commands the stair lift module to move the seat to the top of the stairs so that the seat is available for the user, who is on the upper floor.

The monitoring server can also command the automation controls to adjust various settings of devices connected to the monitoring system. In scenario 200, the monitoring server commands the controls to turn on the lights on the lower floor and adjust the thermostat to a daytime setting, in preparation for the user 104 descending the stairs.

In scenario 220 of FIG. 2B, based on stair lift data and monitoring system data received from the control unit, the monitoring server determined that the user is going to bed for the night. For example, the monitoring server may have received stair lift data indicating that the stair lift seat is moving from the lower floor to the upper floor and that the time is 11:00 PM. In some examples, the user may notify the monitoring server that he is going to bed (e.g., by pressing a button on a monitoring system device or sending a message using an application on his mobile device).

Based on determining that the user is going to bed, the monitoring server performs monitoring system actions that include turning off one or more lights on the lower floor, adjusting the thermostat to a nighttime setting, and setting the monitoring system status to "armed."

In scenario 240 of FIG. 2C, based on stair lift data and monitoring system data received from the control unit, the monitoring server determined that the user is on the upper floor while the stair lift seat is at the base of the stairs, near the lower floor. For example, the monitoring server may have received motion sensing data detecting movement on the upper level, as well as stair lift data indicating that the stair lift seat is in contact with a sensor at the base of the stairs. In some examples, the monitoring server may have received image data from a camera in the home showing the user on the upper floor of the home.

Based on determining that the user is on the upper floor while the stair lift seat is at the base of the stairs, the monitoring server commands the stair lift module to move the stair lift seat to the top of the stairs so that the seat is available for the user.

In some implementations, the monitoring server analyzes stair lift data and monitoring system data to determine an activity pattern of the user. In some cases, the monitoring server associates an activity pattern with a potential event. For example, in scenarios 200 and 220 above, the monitoring server analyzed the received data to determine activity patterns associated with the user waking-up and going to bed, respectively.

The monitoring server can also analyze data to determine activity patterns that include stair lift usage (e.g., the stair lift seat was moved between the upper and lower floor three times in a given day). The activity patterns can be stored by the monitoring server, for example, in a memory system of the monitoring server. In some examples, the monitoring server provides the stored activity data (or one or more summaries of the activity data) to the user and/or to the caregiver, enabling them to monitor the user's mobility and activity.

In some implementations, the monitoring server may use stored activity data to train and/or update a machine learning model. For example, the monitoring server may use stored activity data to train and update a machine learning model used to detect potential events (e.g., the user has experienced a hazardous event, the user has awoken for the day, the user is going to bed at night, etc.).

Figure 3:
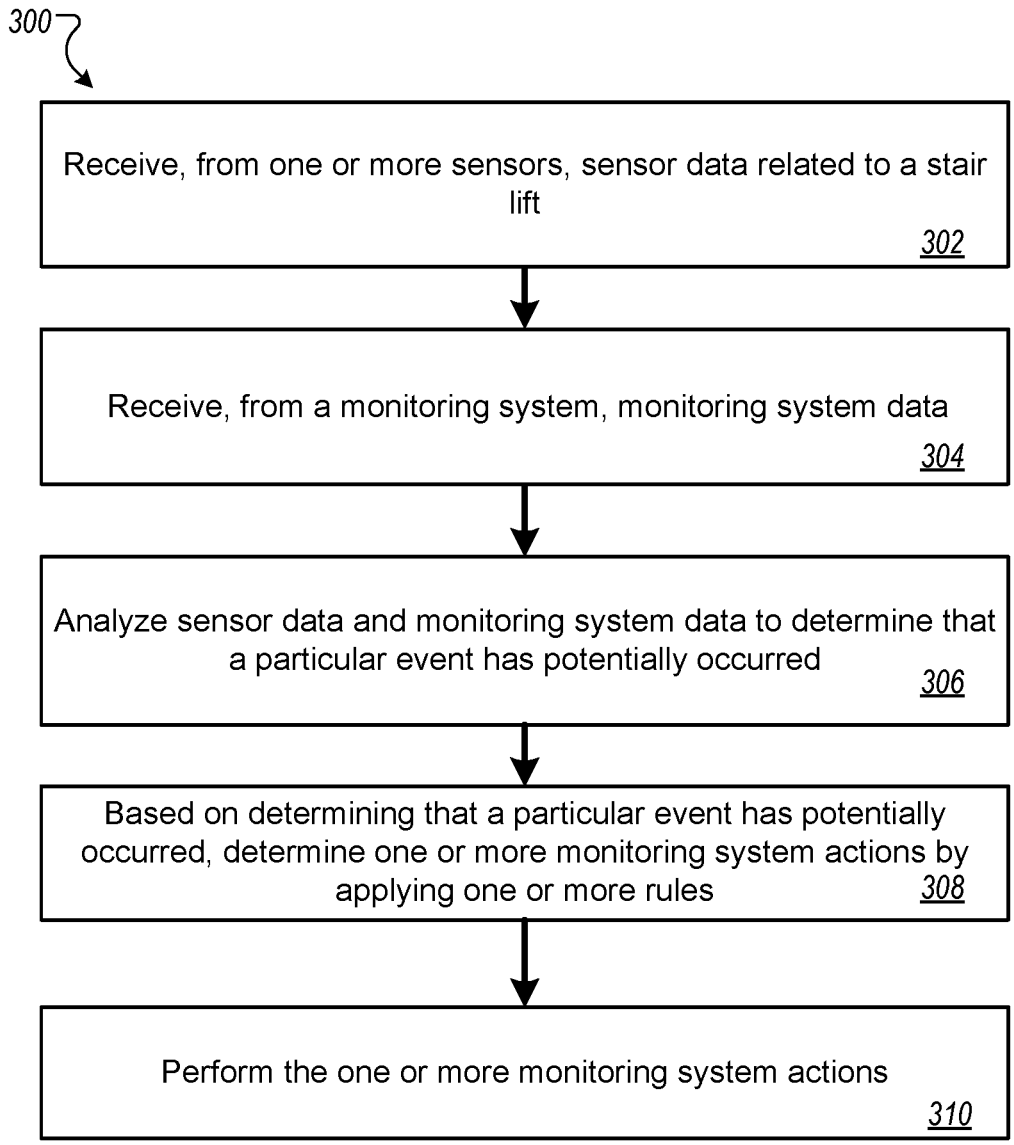
FIG. 3 is a flow chart illustrating an example of a method for stair lift monitoring.

FIG. 3 is a flow chart illustrating an example of a method 300 for stair lift monitoring. The method 300 can be implemented by one or more computer systems, for example, the monitoring server 160 of the system 100. Briefly, the method 300 includes receiving, from one or more sensors, sensor data related to a stair lift (302); receiving, from a monitoring system, monitoring system data (304); analyzing sensor data and monitoring system data to determine that a particular event has potentially occurred (306); based on determining that a particular event has potentially occurred, determining one or more monitoring system actions by applying one or more rules (308); and performing the one or more monitoring system actions (310).

In more detail, the monitoring server receives, from one or more sensors, sensor data related to a stair lift (302). The sensor data can include, for example, data from one or more sensors along the stair lift (e.g., a base sensor and a top sensor) or data from a sensor of the stair lift seat. The sensor data can indicate a location of the stair lift seat (e.g., at the bottom of the lift, at the top of the lift, at a location along the stairs between the bottom and top of the lift), or an occupancy of the stair lift seat (e.g., seat is occupied, seat is unoccupied). The sensor data can indicate whether the stair lift seat is in motion and/or the seat's speed.

In some implementations, the monitoring server receives the sensor data related to a stair lift over a data link from a monitoring system control unit. The control unit may receive the sensor data from a stair lift module connected to the stair lift, where the stair lift module collects data from one or more stair lift sensors.

The monitoring server also receives, from a monitoring system, monitoring system data (304). For example, the monitoring server can receive monitoring system data from the control unit over the data link. The monitoring system data can include data from one or more sensors of the monitoring system (e.g., motion detectors, door or window lock sensors, appliance sensors, resource usage sensors). The monitoring system data can also include image data from one or more cameras of the monitoring system, status data of the system (e.g, "armed," "home," "away"), and data provided by a user of the monitoring system (e.g., data input through a button press, a control panel, or an application running on a mobile device or other computing device). The monitoring system data can include information related to one or more devices connected to the monitoring system, for example, a status or a setting of a device (e.g., a status of one or more lights in the home, a setting of a thermostat or HVAC system, a setting of an appliance). The monitoring system data can include time and/or date information, or other context information.

In method 300, the monitoring server analyzes the sensor data and monitoring system data to determine that a particular event has potentially occurred (306). For example, the monitoring server can analyze sensor data and monitoring system data to determine that a user has potentially fallen from the stair lift seat, that the user has potentially experienced a hazardous event, or that the stair lift has potentially malfunctioned. In some examples, the monitoring system analyzes the data to determine an activity pattern that is associated with a potential event, for example, that the user has awoken for the day or is going to bed for the night. In some examples, the monitoring system may determine that the user is on a particular floor of the home while the stair lift seat is near another floor of the home (e.g., at the opposite end of the stairs).

In some implementations, the monitoring server analyzes the sensor data and monitoring system data using a machine learning model. In some examples, the machine learning model is trained on received or processed sensor data and monitoring system data stored by the monitoring server. In some examples, the machine learning model is updated over time (e.g., learns) using data related to a particular home and/or user.

Based on determining that a particular event has potentially occurred, the monitoring server determines one or more monitoring system actions by applying one or more rules (308). The one or more rules can be predetermined (e.g., default rules). The rules can also be set by the user, the caregiver, or another authorized individual (e.g., through a control panel, through an application running on an authorized device or other computing device).

The monitoring system actions determined by the monitoring server can include, for example, sending a command to a monitoring system sensor or camera (e.g., to initiate recording of data). The actions can also include sending a command to automation controls of the monitoring system to adjust a setting of a device connected to the monitoring system. For example, the monitoring server can send a command to turn on or off a light, to adjust a thermostat setting, or to adjust an appliance setting. In some cases, the monitoring server may sound an audible alarm in the home.

In some implementations, the actions can include sending a command to the stair lift. For example, the server can command the stair lift module to disconnect power to the stair lift, to stop motion of the stair lift seat, or to move the stair lift seat from one location to another location.

In some examples, the actions can include commanding a smart speaker or electronic home assistant to speak to the user in the home or wait for a response from the user.

The actions can include deploying a robotic device (e.g., a drone) to a location near the stair lift. For example, the server can deploy a drone equipped with a camera and/or microphone to go near to the stair lift to obtain video and/or audio data to determine whether the user has experienced a medical emergency or other hazardous event. In some examples, the drone can interact with the user, for example, by landing near the stair lift such that the user can press an emergency button located on the drone. In some examples, the drone includes a speaker and microphone that facilitate communication between the user and emergency personnel (e.g., by calling 911 or a central alarm station).

In some implementations, the actions can include sending a notification or an alert to an authorized mobile device (e.g., a mobile device associated with the user or with the caregiver). In some cases, the monitoring server may provide image data or other sensor data to the mobile device, for example, image data from a camera located near the stair lift.

In some implementations, the actions can include contacting another party, for example, notifying a central alarm server, a security guard, or emergency services personnel (e.g., if the server determined that a medical emergency or other hazardous event potentially occurred).

The method 300 further includes performing the one or more determined monitoring system actions (310). The actions can be performed by the monitoring server or by another device connected to the monitoring system (e.g., the control unit).

Figure 4:
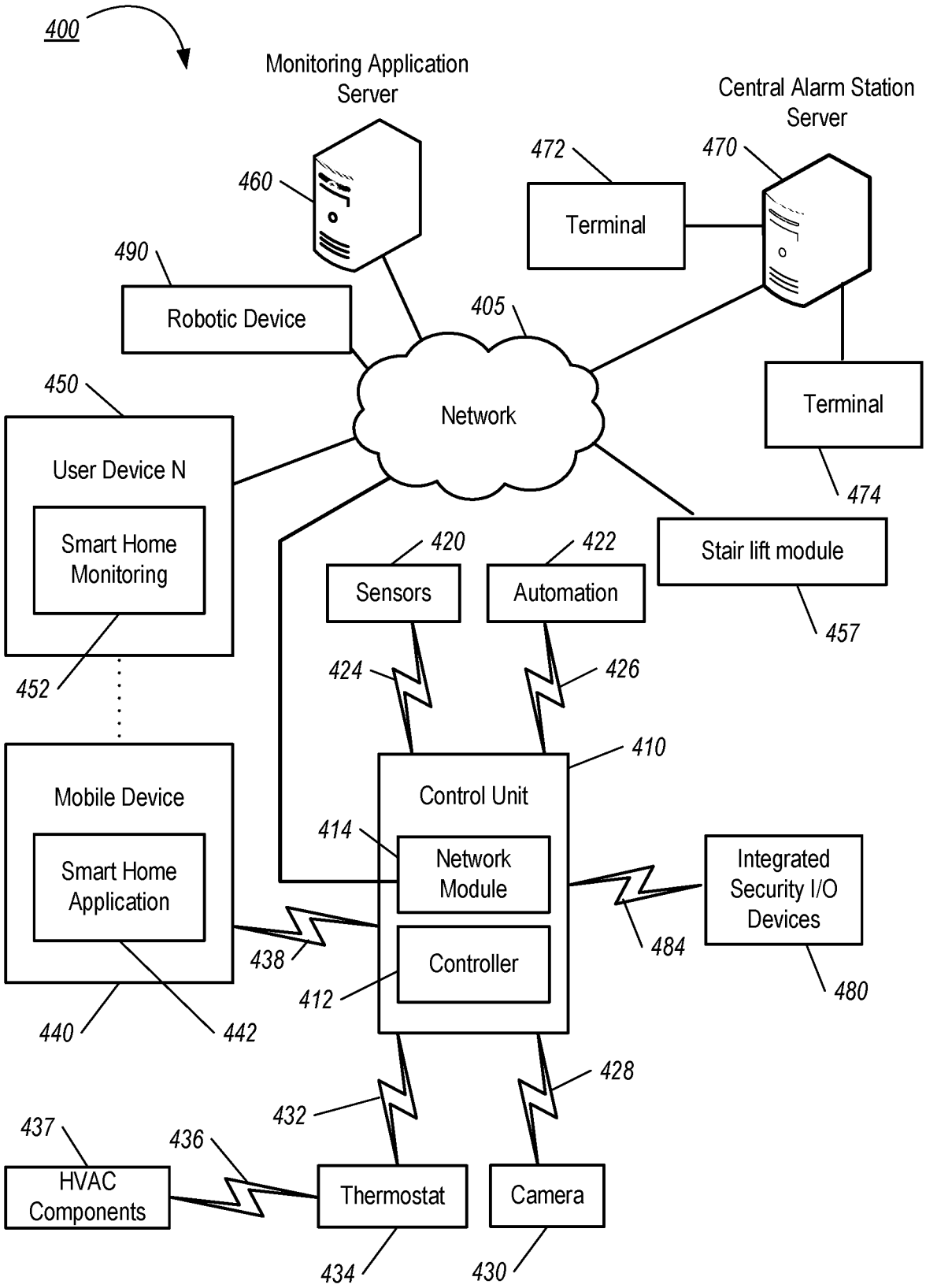
FIG. 4 is a diagram illustrating an example of a home monitoring system.

FIG. 4 is a diagram illustrating an example of a home monitoring system 400. The electronic system 400 includes a network 405, a control unit 410, one or more user devices 440 and 450, a monitoring server 460, and a central alarm station server 470. In some examples, the network 405 facilitates communications between the control unit 410, the one or more user devices 440 and 450, the monitoring server 460, and the central alarm station server 470.

The network 405 is configured to enable exchange of electronic communications between devices connected to the network 405. For example, the network 405 may be configured to enable exchange of electronic communications between the control unit 410, the one or more user devices 440 and 450, the monitoring server 460, and the central alarm station server 470. The network 405 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data. Network 405 may include multiple networks or subnetworks, each of which may include, for example, a wired or wireless data pathway. The network 405 may include a circuit-switched network, a packet-switched data network, or any other network able to carry electronic communications (e.g., data or voice communications). For example, the network 405 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 405 may include one or more networks that include wireless data channels and wireless voice channels. The network 405 may be a wireless network, a broadband network, or a combination of networks including a wireless network and a broadband network.

The control unit 410 includes a controller 412 and a network module 414. The controller 412 is configured to control a control unit monitoring system (e.g., a control unit system) that includes the control unit 410. In some examples, the controller 412 may include a processor or other control circuitry configured to execute instructions of a program that controls operation of a control unit system. In these examples, the controller 412 may be configured to receive input from sensors, flow meters, or other devices included in the control unit system and control operations of devices included in the household (e.g., speakers, lights, doors, etc.). For example, the controller 412 may be configured to control operation of the network module 414 included in the control unit 410.

The network module 414 is a communication device configured to exchange communications over the network 405. The network module 414 may be a wireless communication module configured to exchange wireless communications over the network 405. For example, the network module 414 may be a wireless communication device configured to exchange communications over a wireless data channel and a wireless voice channel. In this example, the network module 414 may transmit alarm data over a wireless data channel and establish a two-way voice communication session over a wireless voice channel. The wireless communication device may include one or more of a LTE module, a GSM module, a radio modem, cellular transmission module, or any type of module configured to exchange communications in one of the following formats: LTE, GSM or GPRS, CDMA, EDGE or EGPRS, EV-DO or EVDO, UMTS, or IP.

The network module 414 also may be a wired communication module configured to exchange communications over the network 405 using a wired connection. For instance, the network module 414 may be a modem, a network interface card, or another type of network interface device. The network module 414 may be an Ethernet network card configured to enable the control unit 410 to communicate over a local area network and/or the Internet. The network module 414 also may be a voice band modem configured to enable the alarm panel to communicate over the telephone lines of Plain Old Telephone Systems (POTS).

The control unit system that includes the control unit 410 includes one or more sensors. For example, the monitoring system may include multiple sensors 420. The sensors 420 may include a lock sensor, a contact sensor, a motion sensor, or any other type of sensor included in a control unit system. The sensors 420 also may include an environmental sensor, such as a temperature sensor, a water sensor, a rain sensor, a wind sensor, a light sensor, a smoke detector, a carbon monoxide detector, an air quality sensor, etc. The sensors 420 further may include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the health monitoring sensor can be a wearable sensor that attaches to a user in the home. The health monitoring sensor can collect various health data, including pulse, heart-rate, respiration rate, sugar or glucose level, bodily temperature, or motion data.

The sensors 420 can also include a radio-frequency identification (RFID) sensor that identifies a particular article that includes a pre-assigned RFID tag.

The control unit 410 communicates with the home automation controls 422 and a camera 430 to perform monitoring. The home automation controls 422 are connected to one or more devices that enable automation of actions in the home. For instance, the home automation controls 422 may be connected to one or more lighting systems and may be configured to control operation of the one or more lighting systems. Also, the home automation controls 422 may be connected to one or more electronic locks at the home and may be configured to control operation of the one or more electronic locks (e.g., control Z-Wave locks using wireless communications in the Z-Wave protocol). Further, the home automation controls 422 may be connected to one or more appliances at the home and may be configured to control operation of the one or more appliances. The home automation controls 422 may include multiple modules that are each specific to the type of device being controlled in an automated manner. The home automation controls 422 may control the one or more devices based on commands received from the control unit 410. For instance, the home automation controls 422 may cause a lighting system to illuminate an area to provide a better image of the area when captured by a camera 430.

The camera 430 may be a video/photographic camera or other type of optical sensing device configured to capture images. For instance, the camera 430 may be configured to capture images of an area within a building or home monitored by the control unit 410. The camera 430 may be configured to capture single, static images of the area and also video images of the area in which multiple images of the area are captured at a relatively high frequency (e.g., thirty images per second). The camera 430 may be controlled based on commands received from the control unit 410.

The camera 430 may be triggered by several different types of techniques. For instance, a Passive Infra-Red (PIR) motion sensor may be built into the camera 430 and used to trigger the camera 430 to capture one or more images when motion is detected. The camera 430 also may include a microwave motion sensor built into the camera and used to trigger the camera 430 to capture one or more images when motion is detected. The camera 430 may have a "normally open" or "normally closed" digital input that can trigger capture of one or more images when external sensors (e.g., the sensors 420, PIR, door/window, etc.) detect motion or other events. In some implementations, the camera 430 receives a command to capture an image when external devices detect motion or another potential alarm event. The camera 430 may receive the command from the controller 412 or directly from one of the sensors 420.

In some examples, the camera 430 triggers integrated or external illuminators (e.g., Infra-Red, Z-wave controlled "white" lights, lights controlled by the home automation controls 422, etc.) to improve image quality when the scene is dark. An integrated or separate light sensor may be used to determine if illumination is desired and may result in increased image quality.

The camera 430 may be programmed with any combination of time/day schedules, system "arming state", or other variables to determine whether images should be captured or not when triggers occur. The camera 430 may enter a low-power mode when not capturing images. In this case, the camera 430 may wake periodically to check for inbound messages from the controller 412. The camera 430 may be powered by internal, replaceable batteries if located remotely from the control unit 410. The camera 430 may employ a small solar cell to recharge the battery when light is available. Alternatively, the camera 430 may be powered by the controller's 412 power supply if the camera 430 is co-located with the controller 412.

In some implementations, the camera 430 communicates directly with the monitoring server 460 over the Internet. In these implementations, image data captured by the camera 430 does not pass through the control unit 410 and the camera 430 receives commands related to operation from the monitoring server 460.

The system 400 also includes thermostat 434 to perform dynamic environmental control at the home. The thermostat 434 is configured to monitor temperature and/or energy consumption of an HVAC system associated with the thermostat 434, and is further configured to provide control of environmental (e.g., temperature) settings. In some implementations, the thermostat 434 can additionally or alternatively receive data relating to activity at a home and/or environmental data at a home, e.g., at various locations indoors and outdoors at the home. The thermostat 434 can directly measure energy consumption of the HVAC system associated with the thermostat, or can estimate energy consumption of the HVAC system associated with the thermostat 434, for example, based on detected usage of one or more components of the HVAC system associated with the thermostat 434. The thermostat 434 can communicate temperature and/or energy monitoring information to or from the control unit 410 and can control the environmental (e.g., temperature) settings based on commands received from the control unit 410.

In some implementations, the thermostat 434 is a dynamically programmable thermostat and can be integrated with the control unit 410. For example, the dynamically programmable thermostat 434 can include the control unit 410, e.g., as an internal component to the dynamically programmable thermostat 434. In addition, the control unit 410 can be a gateway device that communicates with the dynamically programmable thermostat 434. In some implementations, the thermostat 434 is controlled via one or more home automation controls 422.

A module 437 is connected to one or more components of an HVAC system associated with a home, and is configured to control operation of the one or more components of the HVAC system. In some implementations, the module 437 is also configured to monitor energy consumption of the HVAC system components, for example, by directly measuring the energy consumption of the HVAC system components or by estimating the energy usage of the one or more HVAC system components based on detecting usage of components of the HVAC system. The module 437 can communicate energy monitoring information and the state of the HVAC system components to the thermostat 434 and can control the one or more components of the HVAC system based on commands received from the thermostat 434.

The system 400 includes one or more stair lift modules 457. Each of the one or more stair lift module 457 connects to a stair lift of the home. The stair lift modules 457 can be computing devices (e.g., a computer, microcontroller, FPGA, ASIC, or other device capable of electronic computation) capable of receiving data related to the stair lift and communicating electronically with the monitoring system control unit 410. The stair lift module 457 can be integrated into the stair lift by the stair lift manufacturer, or can be connected by a third party. The stair lift module 457 can be located on a stationary or movable component of the stair lift, for example, it can be attached to the stair lift seat.

In some implementations, electric power to the stair lift is routed through the stair lift module 457 such that the stair lift module 457 can connect or disconnect power to the stair lift, e.g., by setting a switch.

The stair lift module 457 receives data from one or more stair lift sensors. The stair lift sensors can include, for example, sensors that detect a location of the stair lift seat (e.g., at the base of the stairs, partway up the stairs, at the top of the stairs). The stair lift sensors can also include force, pressure, or other sensors on the stair lift seat that detect occupancy of the seat. For example, the stair lift sensor can include a pressure-sensitive mat placed on or in the seat that detects the weight of a person sitting in the seat. In some examples, the stair lift sensors can indicate motion of the seat (whether it is in motion, its speed, and other motion parameters).

The stair lift module 457 can receive data from the one or more stair lift sensors through any combination of wired and/or wireless data links. For example, the stair lift module 457 can receive sensor data via a Bluetooth, Bluetooth LE, Z-wave, or Zigbee data link.

The stair lift module 457 communicates electronically with the control unit 410. For example, the stair lift module 457 can send data related to the stair lift to the control unit 410 and receive commands related to stair lift operation. In some examples, the stair lift module 457 processes or generates stair lift data prior to sending it to the control unit 410.

In some examples, the system 400 further includes one or more robotic devices 490. The robotic devices 490 may be any type of robots that are capable of moving and taking actions that assist in home monitoring. For example, the robotic devices 490 may include drones that are capable of moving throughout a home based on automated control technology and/or user input control provided by a user. In this example, the drones may be able to fly, roll, walk, or otherwise move about the home. The drones may include helicopter type devices (e.g., quad copters), rolling helicopter type devices (e.g., roller copter devices that can fly and also roll along the ground, walls, or ceiling) and land vehicle type devices (e.g., automated cars that drive around a home). In some cases, the robotic devices 490 may be robotic devices 490 that are intended for other purposes and merely associated with the system 400 for use in appropriate circumstances. For instance, a robotic vacuum cleaner device may be associated with the monitoring system 400 as one of the robotic devices 490 and may be controlled to take action responsive to monitoring system events.

In some examples, the robotic devices 490 automatically navigate within a home. In these examples, the robotic devices 490 include sensors and control processors that guide movement of the robotic devices 490 within the home. For instance, the robotic devices 490 may navigate within the home using one or more cameras, one or more proximity sensors, one or more gyroscopes, one or more accelerometers, one or more magnetometers, a global positioning system (GPS) unit, an altimeter, one or more sonar or laser sensors, and/or any other types of sensors that aid in navigation about a space. The robotic devices 490 may include control processors that process output from the various sensors and control the robotic devices 490 to move along a path that reaches the desired destination and avoids obstacles. In this regard, the control processors detect walls or other obstacles in the home and guide movement of the robotic devices 490 in a manner that avoids the walls and other obstacles.

In addition, the robotic devices 490 may store data that describes attributes of the home. For instance, the robotic devices 490 may store a floorplan and/or a three-dimensional model of the home that enables the robotic devices 490 to navigate the home. During initial configuration, the robotic devices 490 may receive the data describing attributes of the home, determine a frame of reference to the data (e.g., a home or reference location in the home), and navigate the home based on the frame of reference and the data describing attributes of the home. Further, initial configuration of the robotic devices 490 also may include learning of one or more navigation patterns in which a user provides input to control the robotic devices 490 to perform a specific navigation action (e.g., fly to an upstairs bedroom and spin around while capturing video and then return to a home charging base). In this regard, the robotic devices 490 may learn and store the navigation patterns such that the robotic devices 490 may automatically repeat the specific navigation actions upon a later request.

In some examples, the robotic devices 490 may include data capture and recording devices. In these examples, the robotic devices 490 may include one or more cameras, one or more motion sensors, one or more microphones, one or more biometric data collection tools, one or more temperature sensors, one or more humidity sensors, one or more air flow sensors, and/or any other types of sensors that may be useful in capturing monitoring data related to the home and users in the home. The one or more biometric data collection tools may be configured to collect biometric samples of a person in the home with or without contact of the person. For instance, the biometric data collection tools may include a fingerprint scanner, a hair sample collection tool, a skin cell collection tool, and/or any other tool that allows the robotic devices 490 to take and store a biometric sample that can be used to identify the person (e.g., a biometric sample with DNA that can be used for DNA testing).

In some implementations, the robotic devices 490 may include output devices. In these implementations, the robotic devices 490 may include one or more displays, one or more speakers, and/or any type of output devices that allow the robotic devices 490 to communicate information to a nearby user.

The robotic devices 490 also may include a communication module that enables the robotic devices 490 to communicate with the control unit 410, each other, and/or other devices. The communication module may be a wireless communication module that allows the robotic devices 490 to communicate wirelessly. For instance, the communication module may be a Wi-Fi module that enables the robotic devices 490 to communicate over a local wireless network at the home. The communication module further may be a 900 MHz wireless communication module that enables the robotic devices 490 to communicate directly with the control unit 410. Other types of short-range wireless communication protocols, such as Bluetooth, Bluetooth LE, Z-wave, Zigbee, etc., may be used to allow the robotic devices 490 to communicate with other devices in the home. In some implementations, the robotic devices 490 may communicate with each other or with other devices of the system 400 through the network 405.

The robotic devices 490 further may include processor and storage capabilities. The robotic devices 490 may include any suitable processing devices that enable the robotic devices 490 to operate applications and perform the actions described throughout this disclosure. In addition, the robotic devices 490 may include solid state electronic storage that enables the robotic devices 490 to store applications, configuration data, collected sensor data, and/or any other type of information available to the robotic devices 490.

The robotic devices 490 are associated with one or more charging stations. The charging stations may be located at predefined home base or reference locations in the home. The robotic devices 490 may be configured to navigate to the charging stations after completion of tasks needed to be performed for the monitoring system 400. For instance, after completion of a monitoring operation or upon instruction by the control unit 410, the robotic devices 490 may be configured to automatically fly to and land on one of the charging stations. In this regard, the robotic devices 490 may automatically maintain a fully charged battery in a state in which the robotic devices 490 are ready for use by the monitoring system 400.

The charging stations may be contact based charging stations and/or wireless charging stations. For contact based charging stations, the robotic devices 490 may have readily accessible points of contact that the robotic devices 490 are capable of positioning and mating with a corresponding contact on the charging station. For instance, a helicopter type robotic device may have an electronic contact on a portion of its landing gear that rests on and mates with an electronic pad of a charging station when the helicopter type robotic device lands on the charging station. The electronic contact on the robotic device may include a cover that opens to expose the electronic contact when the robotic device is charging and closes to cover and insulate the electronic contact when the robotic device is in operation.

For wireless charging stations, the robotic devices 490 may charge through a wireless exchange of power. In these cases, the robotic devices 490 need only locate themselves closely enough to the wireless charging stations for the wireless exchange of power to occur. In this regard, the positioning needed to land at a predefined home base or reference location in the home may be less precise than with a contact based charging station. Based on the robotic devices 490 landing at a wireless charging station, the wireless charging station outputs a wireless signal that the robotic devices 490 receive and convert to a power signal that charges a battery maintained on the robotic devices 490.

In some implementations, each of the robotic devices 490 has a corresponding and assigned charging station such that the number of robotic devices 490 equals the number of charging stations. In these implementations, the robotic devices 490 always navigate to the specific charging station assigned to that robotic device. For instance, a first robotic device may always use a first charging station and a second robotic device may always use a second charging station.

In some examples, the robotic devices 490 may share charging stations. For instance, the robotic devices 490 may use one or more community charging stations that are capable of charging multiple robotic devices 490. The community charging station may be configured to charge multiple robotic devices 490 in parallel. The community charging station may be configured to charge multiple robotic devices 490 in serial such that the multiple robotic devices 490 take turns charging and, when fully charged, return to a predefined home base or reference location in the home that is not associated with a charger. The number of community charging stations may be less than the number of robotic devices 490.

Also, the charging stations may not be assigned to specific robotic devices 490 and may be capable of charging any of the robotic devices 490. In this regard, the robotic devices 490 may use any suitable, unoccupied charging station when not in use. For instance, when one of the robotic devices 490 has completed an operation or is in need of battery charge, the control unit 410 references a stored table of the occupancy status of each charging station and instructs the robotic device to navigate to the nearest charging station that is unoccupied.

The system 400 further includes one or more integrated security devices 480. The one or more integrated security devices may include any type of device used to provide alerts based on received sensor data. For instance, the one or more control units 410 may provide one or more alerts to the one or more integrated security input/output devices 480. Additionally, the one or more control units 410 may receive one or more sensor data from the sensors 420 and determine whether to provide an alert to the one or more integrated security input/output devices 480.

The sensors 420, the home automation controls 422, the camera 430, the thermostat 434, and the integrated security devices 480 may communicate with the controller 412 over communication links 424, 426, 428, 432, 438, and 484. The communication links 424, 426, 428, 432, 438, and 484 may be a wired or wireless data pathway configured to transmit signals from the sensors 420, the home automation controls 422, the camera 430, the thermostat 434, and the integrated security devices 480 to the controller 412. The sensors 420, the home automation controls 422, the camera 430, the thermostat 434, and the integrated security devices 480 may continuously transmit sensed values to the controller 412, periodically transmit sensed values to the controller 412, or transmit sensed values to the controller 412 in response to a change in a sensed value.

The communication links 424, 426, 428, 432, 438, and 484 may include a local network. The sensors 420, the home automation controls 422, the camera 430, the thermostat 434, and the integrated security devices 480, and the controller 412 may exchange data and commands over the local network. The local network may include 802.11 "Wi-Fi" wireless Ethernet (e.g., using low-power Wi-Fi chipsets), Z-Wave, Zigbee, Bluetooth, "Homeplug" or other "Powerline" networks that operate over AC wiring, and a Category 5 (CAT5) or Category 6 (CAT6) wired Ethernet network. The local network may be a mesh network constructed based on the devices connected to the mesh network.

The monitoring server 460 is an electronic device configured to provide monitoring services by exchanging electronic communications with the control unit 410, the one or more user devices 440 and 450, and the central alarm station server 470 over the network 405. For example, the monitoring server 460 may be configured to monitor events (e.g., alarm events) generated by the control unit 410. In this example, the monitoring server 460 may exchange electronic communications with the network module 414 included in the control unit 410 to receive information regarding events (e.g., alerts) detected by the control unit 410. The monitoring server 460 also may receive information regarding events (e.g., alerts) from the one or more user devices 440 and 450.

In some examples, the monitoring server 460 may route alert data received from the network module 414 or the one or more user devices 440 and 450 to the central alarm station server 470. For example, the monitoring server 460 may transmit the alert data to the central alarm station server 470 over the network 405.

The monitoring server 460 may store sensor and image data received from the monitoring system and perform analysis of sensor and image data received from the monitoring system. Based on the analysis, the monitoring server 460 may communicate with and control aspects of the control unit 410 or the one or more user devices 440 and 450.

The monitoring server 460 may provide various monitoring services to the system 400. For example, the monitoring server 460 may analyze the sensor, image, and other data to determine an activity pattern of a resident of the home monitored by the system 400. In some implementations, the monitoring server 460 may analyze the data for alarm conditions or may determine and perform actions at the home by issuing commands to one or more of the controls 422, possibly through the control unit 410.

The central alarm station server 470 is an electronic device configured to provide alarm monitoring service by exchanging communications with the control unit 410, the one or more mobile devices 440 and 450, and the monitoring server 460 over the network 405. For example, the central alarm station server 470 may be configured to monitor alerting events generated by the control unit 410. In this example, the central alarm station server 470 may exchange communications with the network module 414 included in the control unit 410 to receive information regarding alerting events detected by the control unit 410. The central alarm station server 470 also may receive information regarding alerting events from the one or more mobile devices 440 and 450 and/or the monitoring server 460.

The central alarm station server 470 is connected to multiple terminals 472 and 474. The terminals 472 and 474 may be used by operators to process alerting events. For example, the central alarm station server 470 may route alerting data to the terminals 472 and 474 to enable an operator to process the alerting data. The terminals 472 and 474 may include general-purpose computers (e.g., desktop personal computers, workstations, or laptop computers) that are configured to receive alerting data from a server in the central alarm station server 470 and render a display of information based on the alerting data. For instance, the controller 412 may control the network module 414 to transmit, to the central alarm station server 470, alerting data indicating that a sensor 420 detected motion from a motion sensor via the sensors 420. The central alarm station server 470 may receive the alerting data and route the alerting data to the terminal 472 for processing by an operator associated with the terminal 472. The terminal 472 may render a display to the operator that includes information associated with the alerting event (e.g., the lock sensor data, the motion sensor data, the contact sensor data, etc.) and the operator may handle the alerting event based on the displayed information.

In some implementations, the terminals 472 and 474 may be mobile devices or devices designed for a specific function. Although FIG. 4 illustrates two terminals for brevity, actual implementations may include more (and, perhaps, many more) terminals.

The one or more authorized user devices 440 and 450 are devices that host and display user interfaces. For instance, the user device 440 is a mobile device that hosts or runs one or more native applications (e.g., the smart home application 442). The user device 440 may be a cellular phone or a non-cellular locally networked device with a display. The user device 440 may include a cell phone, a smart phone, a tablet PC, a personal digital assistant ("PDA"), or any other portable device configured to communicate over a network and display information. For example, implementations may also include Blackberry-type devices (e.g., as provided by Research in Motion), electronic organizers, iPhone-type devices (e.g., as provided by Apple), iPod devices (e.g., as provided by Apple) or other portable music players, other communication devices, and handheld or portable electronic devices for gaming, communications, and/or data organization. The user device 440 may perform functions unrelated to the monitoring system, such as placing personal telephone calls, playing music, playing video, displaying pictures, browsing the Internet, maintaining an electronic calendar, etc.

The user device 440 includes a smart home application 442. The smart home application 442 refers to a software/firmware program running on the corresponding mobile device that enables the user interface and features described throughout. The user device 440 may load or install the smart home application 442 based on data received over a network or data received from local media. The smart home application 442 runs on mobile devices platforms, such as iPhone, iPod touch, Blackberry, Google Android, Windows Mobile, etc. The smart home application 442 enables the user device 440 to receive and process image and sensor data from the monitoring system.

The user device 450 may be a general-purpose computer (e.g., a desktop personal computer, a workstation, or a laptop computer) that is configured to communicate with the monitoring server 460 and/or the control unit 410 over the network 405. The user device 450 may be configured to display a smart home user interface 452 that is generated by the user device 450 or generated by the monitoring server 460. For example, the user device 450 may be configured to display a user interface (e.g., a web page) provided by the monitoring server 460 that enables a user to perceive images captured by the camera 430 and/or reports related to the monitoring system. Although FIG. 4 illustrates two user devices for brevity, actual implementations may include more (and, perhaps, many more) or fewer user devices.

In some implementations, the one or more user devices 440 and 450 communicate with and receive monitoring system data from the control unit 410 using the communication link 438. For instance, the one or more user devices 440 and 450 may communicate with the control unit 410 using various local wireless protocols such as Wi-Fi, Bluetooth, Z-wave, Zigbee, HomePlug (ethernet over power line), or wired protocols such as Ethernet and USB, to connect the one or more user devices 440 and 450 to local security and automation equipment. The one or more user devices 440 and 450 may connect locally to the monitoring system and its sensors and other devices. The local connection may improve the speed of status and control communications because communicating through the network 405 with a remote server (e.g., the monitoring server 460) may be significantly slower.

Although the one or more user devices 440 and 450 are shown as communicating with the control unit 410, the one or more user devices 440 and 450 may communicate directly with the sensors and other devices controlled by the control unit 410. In some implementations, the one or more user devices 440 and 450 replace the control unit 410 and perform the functions of the control unit 410 for local monitoring and long range/offsite communication.

In other implementations, the one or more user devices 440 and 450 receive monitoring system data captured by the control unit 410 through the network 405. The one or more user devices 440, 450 may receive the data from the control unit 410 through the network 405 or the monitoring server 460 may relay data received from the control unit 410 to the one or more user devices 440 and 450 through the network 405. In this regard, the monitoring server 460 may facilitate communication between the one or more user devices 440 and 450 and the monitoring system.

In some implementations, the one or more user devices 440 and 450 may be configured to switch whether the one or more user devices 440 and 450 communicate with the control unit 410 directly (e.g., through link 438) or through the monitoring server 460 (e.g., through network 405) based on a location of the one or more user devices 440 and 450. For instance, when the one or more user devices 440 and 450 are located close to the control unit 410 and in range to communicate directly with the control unit 410, the one or more user devices 440 and 450 use direct communication. When the one or more user devices 440 and 450 are located far from the control unit 410 and not in range to communicate directly with the control unit 410, the one or more user devices 440 and 450 use communication through the monitoring server 460.

Although the one or more user devices 440 and 450 are shown as being connected to the network 405, in some implementations, the one or more user devices 440 and 450 are not connected to the network 405. In these implementations, the one or more user devices 440 and 450 communicate directly with one or more of the monitoring system components and no network (e.g., Internet) connection or reliance on remote servers is needed.

In some implementations, the one or more user devices 440 and 450 are used in conjunction with only local sensors and/or local devices in a house. In these implementations, the system 400 includes the one or more user devices 440 and 450, the sensors 420, the home automation controls 422, the camera 430, the robotic devices 490, and the stair lift module 457. The one or more user devices 440 and 450 receive data directly from the sensors 420, the home automation controls 422, the camera 430, the robotic devices 490, and the stair lift module 457 and sends data directly to the sensors 420, the home automation controls 422, the camera 430, the robotic devices 490, and the stair lift module 457. The one or more user devices 440, 450 provide the appropriate interfaces/processing to provide visual surveillance and reporting.

In other implementations, the system 400 further includes network 405 and the sensors 420, the home automation controls 422, the camera 430, the thermostat 434, the robotic devices 490, and the stair lift module 457 are configured to communicate sensor and image data to the one or more user devices 440 and 450 over network 405 (e.g., the Internet, cellular network, etc.). In yet another implementation, the sensors 420, the home automation controls 422, the camera 430, the thermostat 434, the robotic devices 490, and the stair lift module 457 (or a component, such as a bridge/router) are intelligent enough to change the communication pathway from a direct local pathway when the one or more user devices 440 and 450 are in close physical proximity to the sensors 420, the home automation controls 422, the camera 430, the thermostat 434, the robotic devices 490, and the stair lift module 457 to a pathway over network 405 when the one or more user devices 440 and 450 are farther from the sensors 420, the home automation controls 422, the camera 430, the thermostat 434, the robotic devices 490, and the stair lift module. In some examples, the system leverages GPS information from the one or more user devices 440 and 450 to determine whether the one or more user devices 440 and 450 are close enough to the sensors 420, the home automation controls 422, the camera 430, the thermostat 434, the robotic devices 490, and the stair lift module 457 to use the direct local pathway or whether the one or more user devices 440 and 450 are far enough from the sensors 420, the home automation controls 422, the camera 430, the thermostat 434, the robotic devices 490, and the stair lift module 457 that the pathway over network 405 is required. In other examples, the system leverages status communications (e.g., pinging) between the one or more user devices 440 and 450 and the sensors 420, the home automation controls 422, the camera 430, the thermostat 434, the robotic devices 490, and the stair lift module 457 to determine whether communication using the direct local pathway is possible. If communication using the direct local pathway is possible, the one or more user devices 440 and 450 communicate with the sensors 420, the home automation controls 422, the camera 430, the thermostat 434, the robotic devices 490, and the stair lift module 457 using the direct local pathway. If communication using the direct local pathway is not possible, the one or more user devices 440 and 450 communicate with the sensors 420, the home automation controls 422, the camera 430, the thermostat 434, the robotic devices 490, and the stair lift module 457 using the pathway over network 405.

In some implementations, the system 400 provides end users with access to images captured by the camera 430 to aid in decision making. The system 400 may transmit the images captured by the camera 430 over a wireless WAN network to the user devices 440 and 450. Because transmission over a wireless WAN network may be relatively expensive, the system 400 can use several techniques to reduce costs while providing access to significant levels of useful visual information (e.g., compressing data, down-sampling data, sending data only over inexpensive LAN connections, or other techniques).

In some implementations, a state of the monitoring system and other events sensed by the monitoring system may be used to enable/disable video/image recording devices (e.g., the camera 430). In these implementations, the camera 430 may be set to capture images on a periodic basis when the alarm system is armed in an "away" state, but set not to capture images when the alarm system is armed in a "home" state or disarmed. In addition, the camera 430 may be triggered to begin capturing images when the alarm system detects an event, such as an alarm event, a door-opening event for a door that leads to an area within a field of view of the camera 430, or motion in the area within the field of view of the camera 430. In other implementations, the camera 430 may capture images continuously, but the captured images may be stored or transmitted over a network when needed.

In some implementations, any actions or processes performed by any of the control unit 410, the stair lift module 457, the robotic device 490, the monitoring application server 460, and/or the central alarm station server 470 may be performed by any of the control unit 410, the stair lift module 457, the robotic device 490, the monitoring application server 460, and/or the central alarm station server 470.

The described systems, methods, and techniques may be implemented in digital electronic circuitry, computer hardware, firmware, software, or in combinations of these elements. Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device. Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially designed AS ICs (application-specific integrated circuits).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

What is claimed is:

1. A monitoring system that is configured to monitor a property, the monitoring system comprising:

a sensor that is configured to generate sensor data that reflects an attribute of the property;

a stair lift that is configured to transport a person up and down stairs at the property and that is configured to generate stair lift data that reflects a status of the stair lift; and a monitor control unit that is configured to:

receive the sensor data and the stair lift data;

analyze the sensor data and the stair lift data;

based on analyzing the sensor data and the stair lift data, determine that an event occurred at the property; and based on determining that the event occurred at the property, perform a monitoring system action, wherein the monitor control unit is configured to:

determine that the event occurred at the property by determining that the stair lift is being misused; and perform the monitoring system action by outputting a notification indicating that the stair lift is being misused.

2. The monitoring system of claim 1, wherein:

the stair lift includes a stair lift module that is integrated with the stair lift and that is configured to generate the stair lift data, or the stair lift include a stair lift module that is detachable from the stair lift and that is configured to generate the stair lift data.

3. A monitoring system that is configured to monitor a property, the monitoring system comprising:

a sensor that is configured to generate sensor data that reflects an attribute of the property;

a stair lift that is configured to transport a person up and down stairs at the property and that is configured to generate stair lift data that reflects a status of the stair lift; and a monitor control unit that is configured to:

receive the sensor data and the stair lift data;

analyze the sensor data and the stair lift data;

based on analyzing the sensor data and the stair lift data, determine that an event occurred at the property; and based on determining that the event occurred at the property, perform a monitoring system action, wherein the monitor control unit is configured to:

determine that the event occurred at the property by:

determining that the property is occupied by a resident;

determining that a seat of a stair lift seat is occupied;

determining that the stair lift is not moving and is located between an upper floor and a lower floor; and based on (i) determining that the property is occupied by the resident, (ii) determining that the seat of the stair lift seat is occupied, and (iii) determining that the stair lift is not moving and is located between the upper floor and the lower floor, determining that the resident is located on the stair lift that is not moving and that is located between the upper floor and the lower floor; and perform the monitoring system action by outputting a notification indicating that the resident is located on the stair lift that is not moving and that is located between the upper floor and the lower floor.

4. A monitoring system that is configured to monitor a property, the monitoring system comprising:

a sensor that is configured to generate sensor data that reflects an attribute of the property;

a stair lift that is configured to transport a person up and down stairs at the property and that is configured to generate stair lift data that reflects a status of the stair lift; and a monitor control unit that is configured to:

receive the sensor data and the stair lift data;

analyze the sensor data and the stair lift data;

based on analyzing the sensor data and the stair lift data, determine that an event occurred at the property; and based on determining that the event occurred at the property, perform a monitoring system action;

wherein the monitor control unit is configured to:

determine that the event occurred at the property by:

determining that the property is occupied by a resident;

determining that a seat of a stair lift seat is occupied;

determining that the stair lift is not moving and is located between an upper floor and a lower floor; and based on (i) determining that the property is occupied by the resident, (ii) determining that the seat of the stair lift seat is occupied, and (iii) determining that the stair lift is not moving and is located between the upper floor and the lower floor, determining that the resident is located on the stair lift that is not moving and that is located between the upper floor and the lower floor; and perform the monitoring system action by:

activating a camera that is trained on the stair lift; and outputting image data received from the camera that is trained on the stair lift.

5. A monitoring system that is configured to monitor a property, the monitoring system comprising:

a sensor that is configured to generate sensor data that reflects an attribute of the property;

a stair lift that is configured to transport a person up and down stairs at the property and that is configured to generate stair lift data that reflects a status of the stair lift; and a monitor control unit that is configured to:

receive the sensor data and the stair lift data;

analyze the sensor data and the stair lift data;

based on analyzing the sensor data and the stair lift data, determine that an event occurred at the property; and based on determining that the event occurred at the property, perform a monitoring system action, wherein the monitor control unit is configured to:

determine that the event occurred at the property by:

determining that an upper floor of the property is occupied by a resident;

determining that the resident is moving to a lower floor of the property;

and determining that a seat of the stair lift is located at the lower floor;

and perform the monitoring system action by generating an instruction for the stair lift to move to the upper floor of the property based on (i) determining that the upper floor of the property is occupied by the resident, (ii) determining that the resident is moving to the lower floor of the property, and (iii) determining that the seat of the stair lift is located at the lower floor.

6. The monitoring system of claim 5, wherein the monitor control unit is configured to perform the monitoring system action by:

generating an instruction to activate lights on the lower floor based on (i) determining that the upper floor of the property is occupied by the resident, (ii) determining that the resident is moving to the lower floor of the property, and (iii) determining that the seat of the stair lift is located at the lower floor.

7. A monitoring system that is configured to monitor a property, the monitoring system comprising:

a sensor that is configured to generate sensor data that reflects an attribute of the property;

a stair lift that is configured to transport a person up and down stairs at the property and that is configured to generate stair lift data that reflects a status of the stair lift; and a monitor control unit that is configured to:

receive the sensor data and the stair lift data;

analyze the sensor data and the stair lift data;

based on analyzing the sensor data and the stair lift data, determine that an event occurred at the property; and based on determining that the event occurred at the property, perform a monitoring system action, wherein the monitor control unit is configured to:

determine that the event occurred at the property by:

determining that a lower floor of the property is occupied by a resident;

determining that the resident is moving to an upper floor of the property; and determining that a seat of the stair lift is located at the upper floor; and perform the monitoring system action by generating an instruction for the stair lift to move to the lower floor of the property based on (i) determining that the lower floor of the property is occupied by the resident, (ii) determining that the resident is moving to the upper floor of the property, and (iii) determining that the seat of the stair lift is located at the upper floor.

8. The monitoring system of claim 7, wherein the monitor control unit is configured to perform the monitoring system action by:

generating an instruction to set the monitoring system to armed stay mode based on (i) determining that the lower floor of the property is occupied by the resident, (ii) determining that the resident is moving to the upper floor of the property, and (iii) determining that the seat of the stair lift is located at the upper floor.

9. A monitoring system that is configured to monitor a property, the monitoring system comprising:

a sensor that is configured to generate sensor data that reflects an attribute of the property;

a stair lift that is configured to transport a person up and down stairs at the property and that is configured to generate stair lift data that reflects a status of the stair lift; and a monitor control unit that is configured to:

receive the sensor data and the stair lift data;

analyze the sensor data and the stair lift data;

based on analyzing the sensor data and the stair lift data, determine that an event occurred at the property; and based on determining that the event occurred at the property, perform a monitoring system action, wherein the monitor control unit is configured to:

determine that the event occurred at the property by:

determining that the property is occupied by a resident;

determining that a seat of a stair lift seat is unoccupied;

determining that the stair lift is moving; and based on (i) determining that the property is occupied by the resident, (ii) determining that the seat of the stair lift seat is unoccupied, and (iii) determining that the stair lift is moving, determining that the resident fell off the stair lift; and perform the monitoring system action by outputting a notification indicating that the resident fell off the stair lift.

10. A computer-implemented method, comprising:

receiving, by a monitoring system that is configured to monitor a property and from a sensor, sensor data that reflects an attribute of the property;

receiving, by the monitoring system and from a stair lift that is configured to transport a person up and down stairs at the property, stair lift data that reflects a status of the stair lift;

analyzing, by the monitoring system, the sensor data and the stair lift data;

based on analyzing the sensor data and the stair lift data, determining, by the monitoring system, that an event occurred at the property by determining that the stair lift is being misused;

based on determining that the event occurred at the property, performing, by the monitoring system, a monitoring system action by outputting a notification indicating that the stair lift is being misused.

11. The method of claim 10, wherein:

the stair lift includes a stair lift module that is integrated with the stair lift and that is configured to generate the stair lift data, or the stair lift include a stair lift module that is detachable from the stair lift and that is configured to generate the stair lift data.

12. A computer-implemented method, comprising:

receiving, by a monitoring system that is configured to monitor a property and from a sensor, sensor data that reflects an attribute of the property;

receiving, by the monitoring system and from a stair lift that is configured to transport a person up and down stairs at the property, stair lift data that reflects a status of the stair lift;

analyzing, by the monitoring system, the sensor data and the stair lift data;

based on analyzing the sensor data and the stair lift data, determining, by the monitoring system, that an event occurred at the property;

based on determining that the event occurred at the property, performing, by the monitoring system, a monitoring system action, wherein:

determining that the event occurred at the property comprises:

determining that the property is occupied by a resident;

determining that a seat of a stair lift seat is occupied;

determining that the stair lift is not moving and is located between an upper floor and a lower floor; and based on (i) determining that the property is occupied by the resident, (ii) determining that the seat of the stair lift seat is occupied, and (iii) determining that the stair lift is not moving and is located between the upper floor and the lower floor, determining that the resident is located on the stair lift that is not moving and that is located between the upper floor and the lower floor; and performing the monitoring system action comprises outputting a notification indicating that the resident is located on the stair lift that is not moving and that is located between the upper floor and the lower floor.

13. A computer-implemented method, comprising:

receiving, by a monitoring system that is configured to monitor a property and from a sensor, sensor data that reflects an attribute of the property;

receiving, by the monitoring system and from a stair lift that is configured to transport a person up and down stairs at the property, stair lift data that reflects a status of the stair lift;

analyzing, by the monitoring system, the sensor data and the stair lift data;

based on analyzing the sensor data and the stair lift data, determining, by the monitoring system, that an event occurred at the property;

based on determining that the event occurred at the property, performing, by the monitoring system, a monitoring system action, wherein:

determining that the event occurred at the property comprises:

determining that the property is occupied by a resident;

determining that a seat of a stair lift seat is occupied;

determining that the stair lift is not moving and is located between an upper floor and a lower floor; and based on (i) determining that the property is occupied by the resident, (ii) determining that the seat of the stair lift seat is occupied, and (iii) determining that the stair lift is not moving and is located between the upper floor and the lower floor, determining that the resident is located on the stair lift that is not moving and that is located between the upper floor and the lower floor; and performing the monitoring system action comprises:

activating a camera that is trained on the stair lift; and outputting image data received from the camera that is trained on the stair lift.

14. A computer-implemented method, comprising:

receiving, by a monitoring system that is configured to monitor a property and from a sensor, sensor data that reflects an attribute of the property;

receiving, by the monitoring system and from a stair lift that is configured to transport a person up and down stairs at the property, stair lift data that reflects a status of the stair lift;

analyzing, by the monitoring system, the sensor data and the stair lift data;

based on analyzing the sensor data and the stair lift data, determining, by the monitoring system, that an event occurred at the property;

based on determining that the event occurred at the property, performing, by the monitoring system, a monitoring system action, wherein:

determining that the event occurred at the property comprises:

determining that an upper floor of the property is occupied by a resident;

determining that the resident is moving to a lower floor of the property;

and determining that a seat of the stair lift is located at the lower floor; and performing the monitoring system action by generating an instruction for the stair lift to move to the upper floor of the property based on (i) determining that the upper floor of the property is occupied by a resident, (ii) determining that the resident is moving to the lower floor of the property, and (iii) determining that a seat of the stair lift is located at the lower floor.

15. The method of claim 14, wherein performing a monitoring system action comprises:

generating an instruction to activate lights on the lower floor based on (i) determining that the upper floor of the property is occupied by the resident, (ii) determining that the resident is moving to the lower floor of the property, and (iii) determining that the seat of the stair lift is located at the lower floor.

16. A computer-implemented method, comprising:

receiving, by a monitoring system that is configured to monitor a property and from a sensor, sensor data that reflects an attribute of the property;

receiving, by the monitoring system and from a stair lift that is configured to transport a person up and down stairs at the property, stair lift data that reflects a status of the stair lift;

analyzing, by the monitoring system, the sensor data and the stair lift data;

based on analyzing the sensor data and the stair lift data, determining, by the monitoring system, that an event occurred at the property;

based on determining that the event occurred at the property, performing, by the monitoring system, a monitoring system action, wherein:

determining that the event occurred at the property comprises:

determining that a lower floor of the property is occupied by a resident;

determining that the resident is moving to an upper floor of the property; and determining that a seat of the stair lift is located at the upper floor; and performing the monitoring system action comprises generating an instruction for the stair lift to move to the lower floor of the property based on (i) determining that the lower floor of the property is occupied by the resident, (ii) determining that the resident is moving to the upper floor of the property, and (iii) determining that the seat of the stair lift is located at the upper floor.

17. The method of claim 16, wherein performing the monitoring system action comprises:

generating an instruction to set the monitoring system to armed stay mode based on (i) determining that the lower floor of the property is occupied by the resident, (ii) determining that the resident is moving to the upper floor of the property, and (iii) determining that the seat of the stair lift is located at the upper floor.

18. A computer-implemented method, comprising:

receiving, by a monitoring system that is configured to monitor a property and from a sensor, sensor data that reflects an attribute of the property;

receiving, by the monitoring system and from a stair lift that is configured to transport a person up and down stairs at the property, stair lift data that reflects a status of the stair lift;

analyzing, by the monitoring system, the sensor data and the stair lift data;

based on analyzing the sensor data and the stair lift data, determining, by the monitoring system, that an event occurred at the property;

based on determining that the event occurred at the property, performing, by the monitoring system, a monitoring system action, wherein:

determining that the event occurred at the property by:

determining that the property is occupied by a resident;

determining that a seat of a stair lift seat is unoccupied;

determining that the stair lift is moving; and based on (i) determining that the property is occupied by the resident, (ii) determining that the seat of the stair lift seat is unoccupied, and (iii) determining that the stair lift is moving, determining that the resident fell off the stair lift; and performing the monitoring system action by outputting a notification indicating that the resident fell off the stair lift.

* * * * *